US009144915B2

(12) United States Patent
Watanabe et al.

(10) Patent No.: US 9,144,915 B2
(45) Date of Patent: Sep. 29, 2015

(54) SHEET PROCESSING DEVICE AND IMAGE FORMING SYSTEM

(71) Applicant: CANON KABUSHIKI KAISHA, Tokyo (JP)

(72) Inventors: Kiyoshi Watanabe, Matsudo (JP); Akito Sekigawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 1 day.

(21) Appl. No.: 13/777,674

(22) Filed: Feb. 26, 2013

(65) Prior Publication Data

US 2013/0221596 A1 Aug. 29, 2013

(30) Foreign Application Priority Data

Feb. 29, 2012 (JP) ..... 2012-044510

(51) Int. Cl.

| | |
|---|---|
| ***B26D 7/32*** | (2006.01) |
| ***B26D 7/01*** | (2006.01) |
| ***B26F 1/00*** | (2006.01) |
| ***B65H 29/12*** | (2006.01) |
| ***G03G 15/00*** | (2006.01) |

(52) U.S. Cl.

CPC *B26D 7/32* (2013.01); *B26D 7/015* (2013.01); *B26F 1/0092* (2013.01); *B65H 29/125* (2013.01); *G03G 15/6544* (2013.01); *G03G 15/6573* (2013.01); *G03G 15/6582* (2013.01); *B65H 2301/333* (2013.01); *B65H 2403/72* (2013.01); *B65H 2403/732* (2013.01); *B65H 2403/942* (2013.01); *B65H 2404/1114* (2013.01); *B65H 2511/51* (2013.01); *B65H 2513/412* (2013.01); *B65H 2513/512* (2013.01); *B65H 2513/514* (2013.01); *B65H 2801/27* (2013.01); *Y10T 83/6572* (2015.04)

(58) Field of Classification Search

USPC ..... 270/58.07, 58.11, 58.12, 58.17, 58.27; 271/184, 186, 187, 225, 223, 285, 286

See application file for complete search history.

(56) References Cited

U.S. PATENT DOCUMENTS

| | | | | |
|---|---|---|---|---|
| 6,042,098 | A * | 3/2000 | Kubota et al. | 270/58.02 |
| 6,719,283 | B2 * | 4/2004 | Tsuchiya et al. | 270/58.07 |
| 7,891,651 | B2 * | 2/2011 | Wakabayashi et al. | 270/58.17 |
| 8,023,881 | B2 * | 9/2011 | Watanabe et al. | 399/407 |
| 8,096,543 | B2 * | 1/2012 | Toyoizumi et al. | 270/58.07 |
| 8,104,758 | B2 * | 1/2012 | Tanaka et al. | 270/58.11 |
| 8,123,215 | B2 * | 2/2012 | Kanda | 271/244 |
| 8,177,214 | B2 * | 5/2012 | Sato | 270/58.09 |
| 2008/0258373 | A1 | 10/2008 | Wakabayashi | |
| 2008/0298867 | A1 | 12/2008 | Watanabe | |
| 2010/0301541 | A1 | 12/2010 | Sato | |
| 2011/0272876 | A1 * | 11/2011 | Sugimoto | 271/10.13 |

FOREIGN PATENT DOCUMENTS

| | | | |
|---|---|---|---|
| JP | H10-330020 | A | 12/1998 |
| JP | 2006-069785 | A | 3/2006 |

* cited by examiner

*Primary Examiner* — Leslie A Nicholson, III

(74) *Attorney, Agent, or Firm* — Canon USA, Inc. IP Division

(57) ABSTRACT

A driving roller for conveying a sheet to a sheet punching unit, and a sheet inverting unit including a driving roll capable of being driven to rotate by the driving roller are provided between a branching point, at which a return path of a sheet conveying path is branched, and a sheet punching unit. When a subsequent sheet for which a punching process is performed next reaches the sheet inverting unit, the sheet to which the punching process has been performed by the sheet punching unit is conveyed to the return path by the driving roll while making the sheet pass by a subsequent sheet conveyed to the sheet punching unit by the driving roller.

16 Claims, 12 Drawing Sheets

SHEET PROCESSING DEVICE AND IMAGE FORMING SYSTEM

BACKGROUND OF THE INVENTION

1. Field of the Invention

The present disclosure relates to a sheet processing device and an image forming system. More particularly, the present disclosure relates to a sheet processing device and an image forming system which includes a punching unit configured to perform a punching process in a sheet efficiently.

2. Description of the Related Art

There has been an image forming system in which a sheet processing device is provided in image forming apparatus, such as a copier, a laser beam printer, a facsimile machine and a multi-functional peripheral thereof. The sheet processing device performs, for example, stapling or punching in a sheet in which an image has been formed. In such a sheet processing device, when the punching process is performed in a sheet, the sheet which is being conveyed is first positioned at a position at which the punching process is to be performed. At that position, the punching process is performed to the sheet by the punching unit (see Japanese Patent Laid-Open No. 2006-069785).

In such a related art sheet processing device and an image forming system which includes the sheet processing device, at the time of the punching process, after the sheet is positioned one at a time by a positioning unit, the punching process is performed to the sheet by the punching unit and then the sheet to which the punching process has been performed is conveyed. However, in such a configuration, since a subsequent sheet is not able to be conveyed to the positioning unit until the conveyance of the preceding sheet from the positioning unit and the punching unit is completed, the punching process is not able to be performed efficiently.

Therefore, if the thus-configured sheet processing device is connected to image forming apparatus with high productivity with short sheet feeding intervals, the productivity of the image forming apparatus is adversely affected by the capability of the sheet processing device. That is, it is necessary to perform the punching process by the sheet processing device efficiently in order to maintain high productivity of the entire image formation system.

In view of the aforementioned, the present invention provides a sheet processing device and an image forming system capable of performing a punching process efficiently.

SUMMARY OF THE INVENTION

The present disclosure provides a sheet processing device, including: a punching unit configured to perform a punching process in a sheet; a sheet conveying path configured to guide the sheet to the punching unit; a branching conveying path configured to be branched from the sheet conveying path; a sheet inverting unit provided between a branching point and the punching unit, the branching point being the point at which the branching conveying path is branched from the sheet conveying path, the sheet inverting unit including a first rotary member configured to convey the sheet to the punching unit, and a second rotary member configured to rotate in a forward direction to convey the sheet, which the punching process has been performed by the punching unit, to the branching conveying path from the sheet conveying path and be driven to rotate by the first rotary member in a backward rotation; and wherein, when a subsequent sheet to which the punching process is to be performed the next time is nipped, in such a manner to be in contact with the first rotary member, by the first rotary member and the second rotary member which nip a preceding sheet to which the punching process has already been performed, the second rotary member conveys the preceding sheet to the branching conveying path by the second rotary member while making the preceding sheet pass by the subsequent sheet.

In the present disclosure, when the subsequent sheet reaches the sheet inverting unit, the sheet to which the punching process has been performed is conveyed, by the second rotary member, to the branching conveying path, while passing by the subsequent sheet conveyed to the punching unit by the first rotary member. Therefore, the punching process may be performed efficiently.

Further features of the present invention will become apparent from the following description of exemplary embodiments with reference to the attached drawings.

DESCRIPTION OF THE EMBODIMENTS

Figure 1:
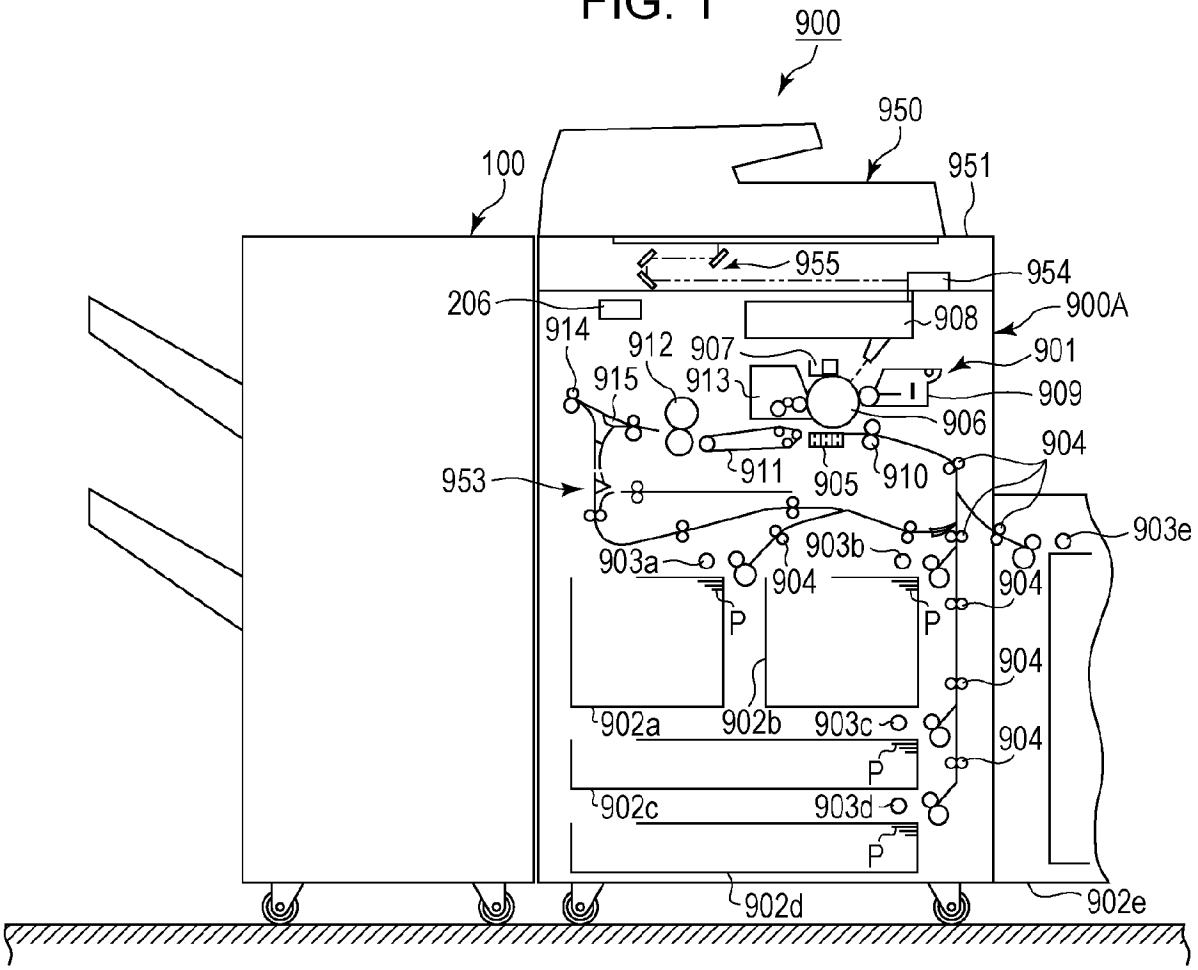
FIG. 1 is a diagram illustrating a configuration of an image forming system which includes a sheet processing device according to an embodiment of the present invention.

Hereinafter, an embodiment of the present disclosure will be described in detail with reference to the drawings. FIG. 1 is a diagram illustrating a configuration of an image forming system which includes a sheet processing device according to an embodiment disclosed herein. In FIG. 1, the reference numeral 900 denotes an image forming apparatus and 900A denotes a main body of the image forming apparatus (hereafter, referred to as an "apparatus main body"). The apparatus main body 900A includes an image reader (i.e., an image reading device) 951 provided with a scanner unit 955 and an image sensor 954, image forming units 901 for forming an image on a sheet, and a double-side device 953. A document feeder 950 configured to feed a document to an unillustrated platen glass is provided on an upper surface of the apparatus main body 900A.

The image forming unit 901 each includes a cylindrical photosensitive drum 906, a charger 907, a developing unit 909 and a cleaning device 913. A fixing device 912 and a discharge roller pair 914 are disposed downstream from the image forming units 901. A finisher 100, which is a sheet processing device for processing the sheet on which image formation has been performed and has been discharged from the apparatus main body 900A, is connected to the apparatus main body 900A. The reference numeral 206 denotes a CPU circuit unit which is a control unit for managing control of the apparatus main body 900A and the finisher 100.

Next, an image formation operation of the thus-configured apparatus main body 900A will be described. When an image formation signal is output from the CPU circuit unit 206, a document is first placed on a platen glass by a document feeder 950. An image of this document is read by an image reader 951 and the read digital data is input to an exposure unit 908. Then the photosensitive drum 906 is irradiated with light in accordance with the digital data by the exposure unit 908. At this time, since a surface of the photosensitive drum 906 is charged uniformly by the charger 907, if the surface is irradiated with light in this manner, an electrostatic latent image is formed on the surface of the photosensitive drum and the toner image is formed on the surface of the photosensitive drum when the electrostatic latent image is developed by the developing unit 909.

When a feed signal is output from the CPU circuit unit 206, a sheet P placed in cassettes 902*a* to 902*d* and a feed deck 902*e* is first conveyed by feed rollers 903*a* to 903*e* and a conveying roller pair 904 to a registration roller 910. Next, the sheet P is conveyed by the registration roller 910 to a transfer unit at a timing such that a leading end of the sheet and a leading end of the toner image on the photosensitive drum are aligned with each other. The transfer unit includes a transfer charger 905. In this transfer unit, when transfer bias is applied to the sheet P by the transfer charger 905, the toner image on the photosensitive drum is transferred to the sheet.

Next, the sheet P to which the toner image has been transferred is conveyed to the fixing device 912 by a conveying belt 911 and the toner image is fixed by heat when the sheet P passes through the fixing device 912. At this time, foreign substances, such as remaining toner, adhering to the photosensitive drum without having been transferred to the sheet P, are scratched out by the cleaning device 913. Then, the surface of the photosensitive drum 906 is cleaned and is prepared for the next image formation.

Next, the sheet to which the toner image has been fixed with heat by the fixing device 912 is directly conveyed to a discharge roller pair 914 by the finisher 100. When images are to be formed on both sides of the sheet P, after the toner image is fixed with heat, the sheet P is conveyed to the double-side device 953 by a switching member 915, a surface on which an image is to be formed is inverted, the sheet P is conveyed to the image forming unit 901 again where an image is formed on the back surface of the sheet P. Then, the sheet P is conveyed to the finisher 100 by the discharge roller pair 914.

Figure 2:
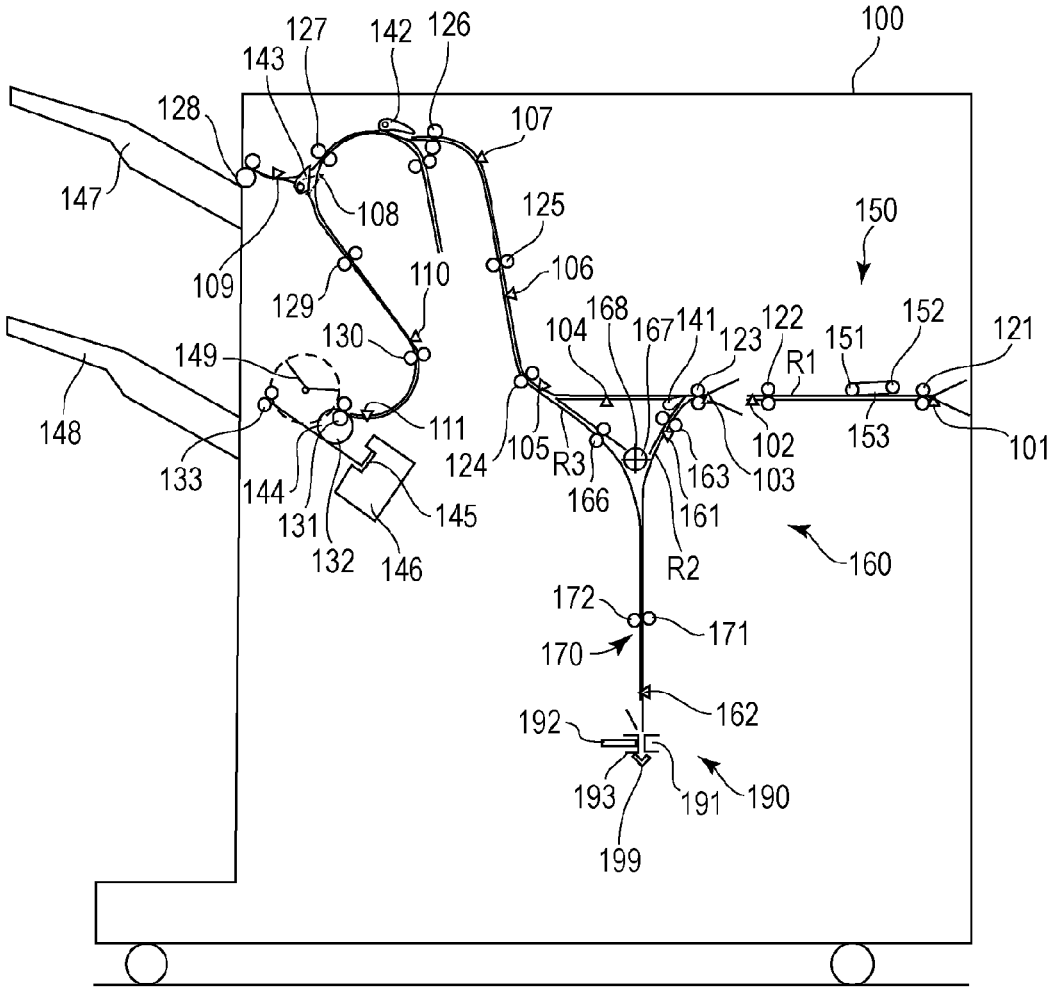
FIG. 2 is a diagram illustrating a configuration of a finisher which is the sheet processing device.

The finisher 100 sequentially takes in the sheets discharged from the apparatus main body 900A and carries out the following processes: aligning and binding up the plurality of taken-in sheets; punching holes in the taken-in sheets (punching process); stapling the bundle of sheets; and other processes. The finisher 100 includes an inlet roller pair 121 for taking the sheet inside of the apparatus as illustrated in FIG. 2. The sheet discharged from the apparatus main body 900A is received and passed to the inlet roller pair 121. The timing at which the sheet is received and passed is also detected by the inlet sensor 101 at this time.

Then, the sheet P conveyed by the inlet roller pair 121 is conveyed by conveying roller pairs 122 to 127 disposed along a conveying path R1 if the punching process is not performed to the sheet P. If the punching process is performed to the sheet P, the sheet P is conveyed to a sheet punching unit 190 described later where the punching process is carried out, and then the sheet P is conveyed by conveying roller pairs 124 to 127. If the sheet P is discharged to an upper tray 147, an upper path switching member 143 is made to be a state illustrated in the broken line in the diagram by the solenoid 401 illustrated in FIG. 8 which will be described later. In this manner, the sheet P is directed to an upper paper discharge roller 128 along upper path switching member 143 and is discharged to the upper tray 147 by the paper discharge roller 128.

If the sheet P is to be discharged to a stacking tray 148, the upper path switching member 143 becomes a state illustrated by a solid line in the diagram. In this manner, the sheet P is directed to conveying roller pairs 129 and 130 along the upper path switching member 143, conveyed by the conveying roller pairs 129 and 130 to a lower discharge roller pair 131 and discharged to an intermediate process tray 144 by the lower discharge roller pair 131. The discharged sheet is sequentially conveyed by a returning member, such as a paddle 149 or a belt roller 132, and a sheet rear end is made to abut against an alignment wall 145 for the alignment in the sheet conveying direction.

Next, alignment of the bundle of sheets in the width direction which intersects perpendicularly with the sheet conveying direction is carried out using an alignment plate which is not illustrated. The bundle of sheets which is thus aligned on the intermediate process tray is stapled using a stapler 146 if necessary, and then discharged to the stacking tray 148 by the bundle discharge roller pair 133.

In FIG. 2, the reference numeral 150 denotes a sheet overlapping portion which is an overlapping unit at which a rear end portion of the sheet P which is the sheet conveying direction upstream end portion overlaps a leading end of the subsequent sheet which is the sheet conveying direction downstream end portion. The sheet overlapping portion 150 includes a conveying suction belt 153 and a suction fan 302 illustrated in FIG. 8 described later. The conveying suction belt 153 is wound around a driven pulley 151 and an idler pulley 152. The driven pulley 151 is driven by a sheet overlap motor 301 illustrated in FIG. 8 described later.

Then the suction fan 302 is driven in accordance with detection signal of the inlet sensor 101, a rear end of the preceding sheet is sucked and is lifted, and then stacked such that the rear end portion of the preceding sheet is placed over the leading end of the subsequent sheet. In order to achieve such a stacking method, the sheet conveyance speed in the sheet overlapping portion 150 is set to be lower than in the sheet conveyance speed of the inlet roller pair 121.

In FIG. 2, R2 denotes a sheet conveying path branched from the conveying path R1, and R3 is a return path which is a branching conveying path branched from the sheet conveying path R2 and on which the sheet P which has been inverted by the sheet inverting unit 170 described later to the conveying path R1. In FIG. 2, the reference numerals 101 to 111 denote sensors which detect existence of the sheet P on the conveying path R1, the sheet conveying path R2 and the return path R3. Here, a sheet punching unit 190 is provided in the sheet conveying direction downstream of the sheet conveying path R2. The sheet punching unit 190 includes a die 191, a punch 192, a punch guide 193, and a positioning stopper 199. The punch 192 is disposed opposite to the die 191 via the sheet conveying path R2 and is driven by the punching motor 306 illustrated in FIG. 8 described later. The positioning stopper 199 is a positioning unit.

If the punching process is carried out to the sheet P guided by the sheet conveying path R2, the sheet P stacked in the above-described manner by the sheet overlapping portion 150 is guided to the sheet conveying path R2 by a switching member 141 provided at a branching point of the conveying path R1 and the sheet conveying path R2. Then, the sheet is conveyed to the sheet punching unit 190 by a feeding roller 163 and a sheet inverting unit 170 which were provided in the sheet conveying path R2. The sheet abuts against the positioning stopper 199 for the positioning. The punch 192 is moved in the state in which the sheet P is aligned, and holes are punched in the sheet P. Abutment of the sheet against the positioning stopper 199 is carried out by conveying the sheet by a predetermined amount in accordance with detection of the sheet by a timing sensor 162.

Figure 3:
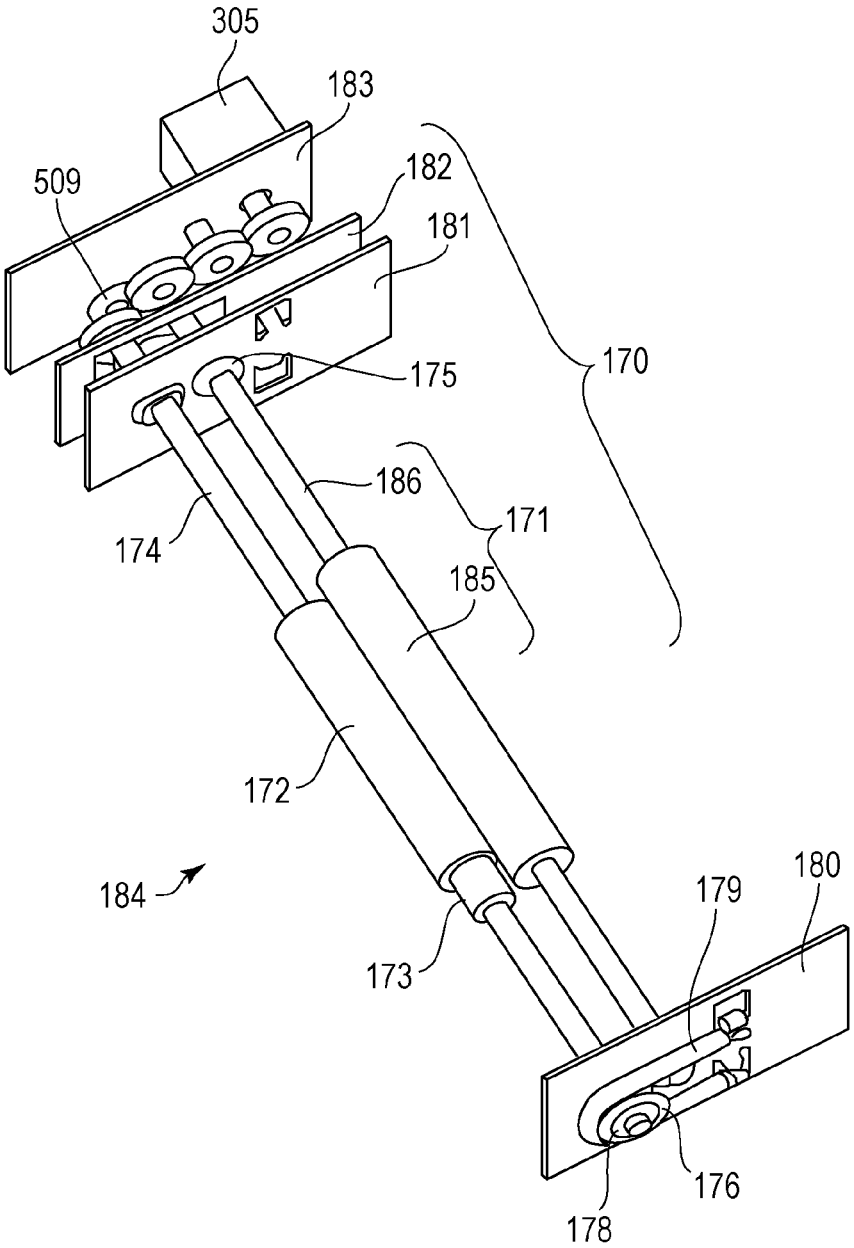
FIG. 3 is a diagram illustrating a configuration of a sheet inverting unit provided in the finisher.

The sheet inverting unit 170 which conveys the sheet, guided to the sheet conveying path R2, to the sheet punching unit 190 is constituted by a driving roller 171 which is a first rotary member and a driving roll 184 which is a second rotary member as illustrated in FIG. 3. Here, the driving roller 171 is formed by press-fitting a driving shaft 186 in a rubber roller 185, and both ends of the driving shaft 186 are rotatably supported by a bearing 175 at a front side plate 180 and a rear side plate 181.

The driving roll 184 rotates in the opposite direction to that of the driving roller 171 and conveys the sheet P to which the punching process has been performed to the return path R3 which will be described later, and is driven to rotate by the driving roller 171. The driving roll 184 is formed by a roll 172 which is supported by a driving shaft 174 via a torque limiter 173. The roll 172 is a plastic-made tubular roll of which outer layer is covered with rubber. When torque of greater than predetermined torque is applied to (the roll 172 of) the driving roll 184, the torque limiter 173 allows rotation of the driving roll 184 to only one direction with respect to the driving shaft 174.

Both ends of the driving shaft 174 of the driving roll 184 are rotatably supported by bearings 178 each of which outer wheel is fixed to a holder 176. Here, the holder 176 is supported by the front side plate 180 and the rear side plate 181 so as to be slidable in a direction of axial center of the driving roller 171 and is urged by a spring 179. In this manner, (the roll 172 of) the driving roll 184 is pressed against (the rubber roller 185 of) the driving roller 171.

Figure 4:
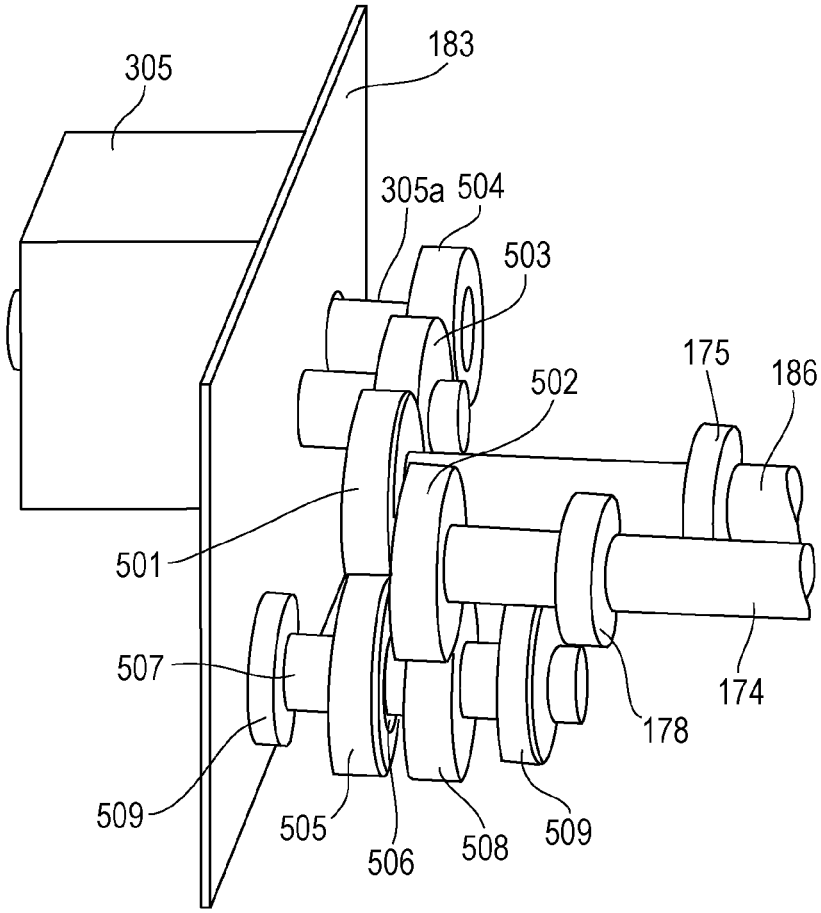
FIG. 4 is a diagram illustrating a driving system of the sheet inverting unit.

Next, a driving system of the sheet inverting unit 170 will be described with reference to FIG. 4. In FIG. 4, for the ease of illustration of the driving system, the rear side plate 181, an auxiliary support plate 182, the holder 176 and the spring 179 are not illustrated.

A first gear 501 is fixed to a side end portion of the rear side plate of the driving shaft 186 of the driving roller 171 and a second gear 502 is fixed to a side end portion of the rear side plate of the driving shaft 174 of the driving roll 184. The first gear 501 meshes with a fourth gear 504 which is fixed to a motor shaft 305*a* of an inversion motor 305 which is capable of rotating in forward and backward directions via an idler gear 503. Therefore, when the inversion motor 305 is rotated in the forward and backward directions, the rotation of the forward and backward directions of the inversion motor 305 is transmitted to the first gear 501 via the fourth gear 504 and the idler gear 503 and the driving roller 171 is rotated in the forward and backward directions.

The first gear 501 meshes also with a fifth gear 505. Here, the fifth gear 505 is attached to a drive transmission shaft 507 via a one-way clutch 506 to be rotatable in one direction. The drive transmission shaft 507 is rotatably supported by the bearings 509 at both ends thereof. Each of the bearings 509 is supported by a motor support plate 183 which is fixed to the rear side plate 181 illustrated in FIG. 3 and the auxiliary support plate 182 which is fixed to the motor support plate 183 illustrated in FIG. 3.

Here, an eighth gear 508 which engages the second gear 502 is fixed to the drive transmission shaft 507. With this configuration, when the fifth gear 505 rotates in a locking direction of the one-way clutch 506, the drive transmission shaft 507 rotates and the eighth gear 508 rotates. Therefore, when the eighth gear 508 rotates, the roll 172 rotates with the driving shaft 174 of the driving roll 184.

Figure 5A:
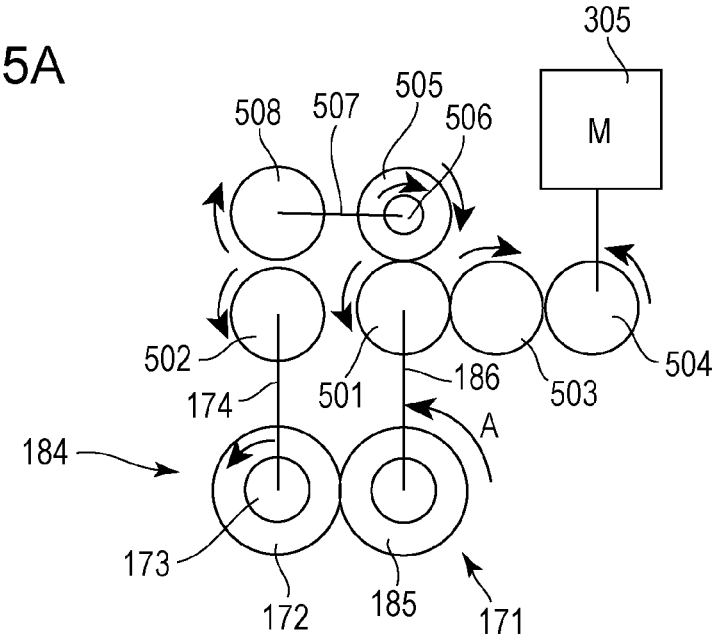
FIGS. 5A to 5C are diagrams illustrating directions of rotation of a driving roller and a driving roll when an inversion motor of the sheet inverting unit is rotated in a forward direction.
Figure 5B:
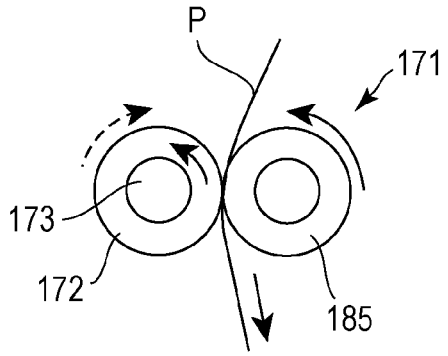
Figure 5C:
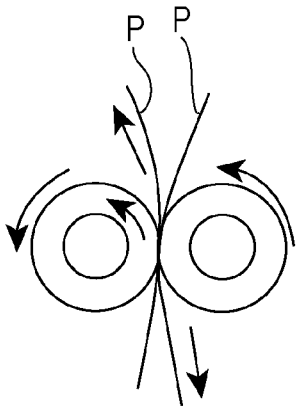

FIGS. 5A to 5C are diagrams illustrating directions of rotation of the driving roller 171 and the driving roll 184 when the inversion motor 305 is rotated in the forward direction. FIG. 5A is a diagram illustrating a state in which the driving roller 171 rotates in the forward direction (i.e., the direction of A in FIG. 5A) as the inversion motor 305 is rotated in the forward direction. This direction of rotation is the direction of rotation in which the one-way clutch 506 locks the drive transmission shaft 507. With this configuration, the drive transmission shaft 507, the eighth gear 508 and the second gear 502 rotate to cause the driving shaft 174 to rotate.

Here, the direction of rotation of the roll 172 during forward rotation of the inversion motor 305 is changed depending on the number of sheets nipped by the roll 172 and the rubber roller 185. For example, if the sheet P is not nipped and if a single sheet is hipped as illustrated in FIG. 5B, the torque applied to the torque limiter 173 becomes greater than the predetermined torque. Therefore, the roll 172 is driven by the rubber roller 185 to rotate in the direction illustrated by the broken line as illustrated in FIG. 5B. If two sheets are nipped as illustrated in FIG. 5C, since the frictional resistance between the sheets is small and the torque applied to the torque limiter 173 becomes smaller than the predetermined torque, the roll 172 rotates in the direction of rotation of the driving shaft 174 without idling. Therefore, the two sheets P are conveyed in the opposite direction while passing by each other.

Figure 6A:
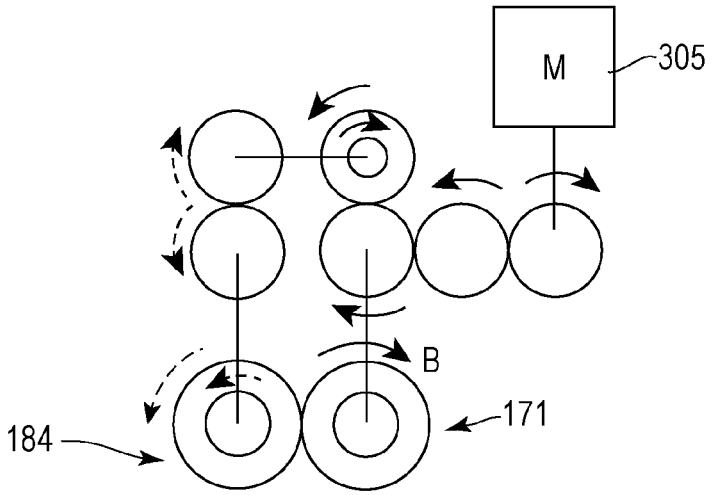
FIGS. 6A and 6B are diagrams illustrating directions of rotation of the driving roller and the driving roll when the inversion motor is rotated in an inverted direction.
Figure 6B:
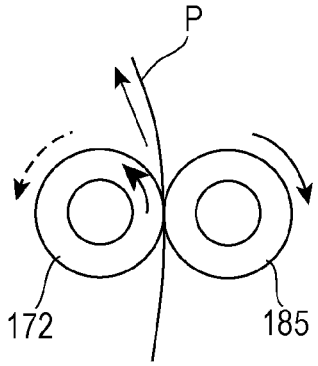

FIGS. 6A and 6B are diagrams illustrating directions of rotation of the driving roller 171 and the driving roll 184 when the inversion motor 305 is rotated in the backward direction. FIG. 6A is a diagram illustrating a state in which the driving roller 171 rotates in the backward direction (i.e., the direction of B in FIG. 6A) as the inversion motor 305 is rotated in the backward direction. This direction of rotation is the direction of rotation in which the one-way clutch 506 is rotated idly and, in this case, the driving is not transmitted to the drive transmission shaft 507. Therefore, the roll 172 is driven to rotate with respect to the rubber roller 185 as illustrated by the broken line in FIG. 6B and the sheet P is conveyed.

Here, driving to rotate in the forward and backward directions of the sheet inverting unit 170 is performed at the timing in accordance with the detection of the leading end of the sheet by a timing sensor 161. The timing sensor 161 is disposed in the upstream of the sheet conveying path R2 illustrated in FIG. 2 for detecting one or two leading ends of overlapped sheets. In the present embodiment, an ultrasonic sensor is used as the timing sensor 161.

Figure 7:
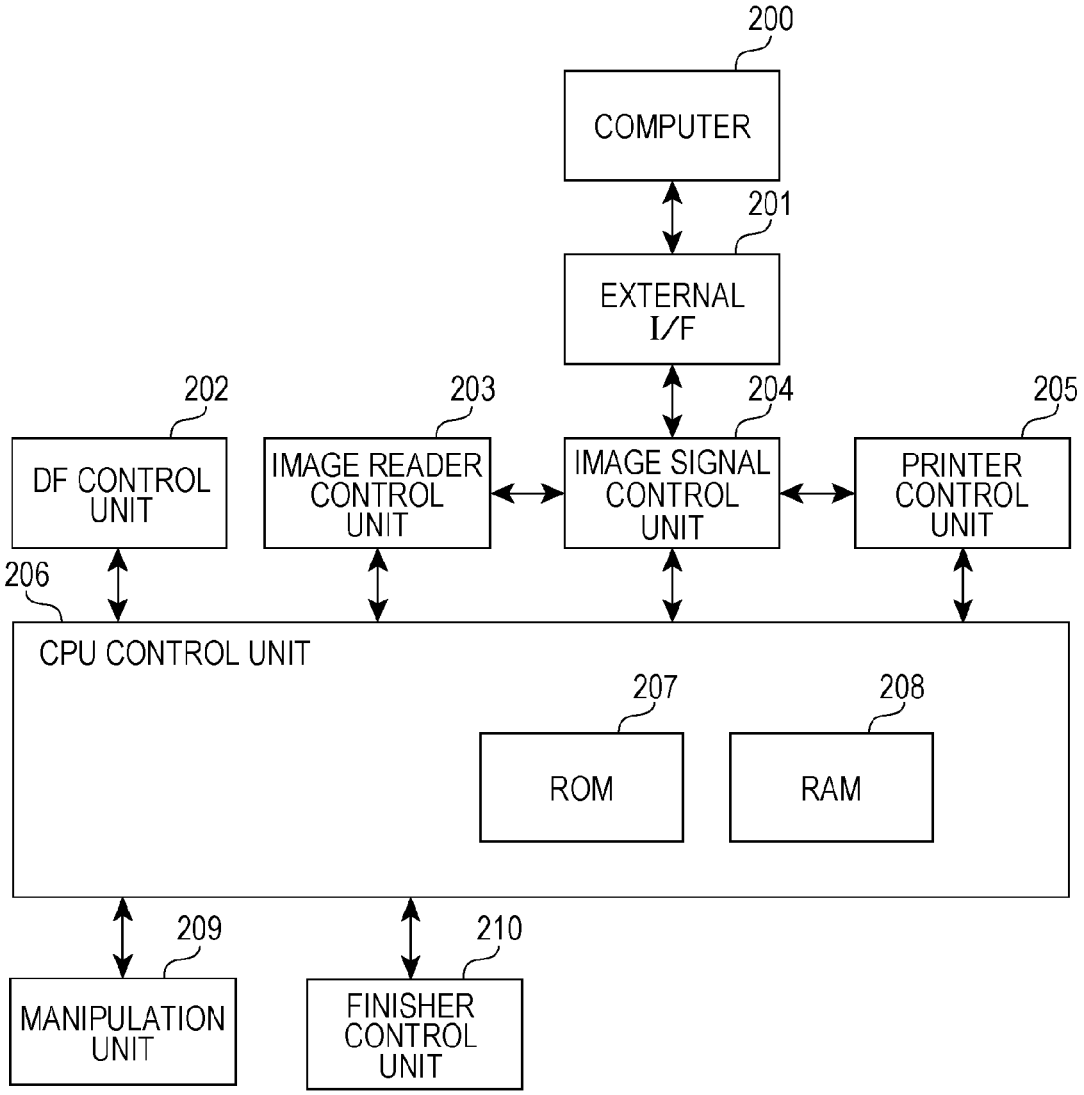
FIG. 7 is a control block diagram of the image forming system.

FIG. 7 is a control block diagram of the image forming apparatus 900. As illustrated in FIG. 7, the CPU circuit unit 206 includes an unillustrated CPU, ROM 207 and RAM 208. The CPU circuit unit 206 controls a document feeder (DF) control unit 202, an image reader control unit 203, an image signal control unit 204, a printer control unit 205, a finisher control unit 210 and an external interface 201. The CPU circuit unit 206 performs the control in accordance with the programs stored in the ROM 207 and in accordance with setting of a manipulation unit 209.

The document feeder (DF) control unit 202 controls the document feeder 950. The image reader control unit 203 controls the image reader. The printer control unit 205 controls the apparatus main body 900A. The finisher control unit 210 controls the finisher 100. In the present embodiment, a configuration in which a finisher control unit 210 is provided in the finisher 100 will be described. However, the present invention is not limited to the same. The finisher control unit 210 may be provided integrally with the CPU circuit unit 206 in the apparatus main body 900A and the finisher 100 may be controlled from the apparatus main body 900A.

The RAM 208 is used as area in which control data is held temporarily, and as a workspace for operations accompanying the control. The external interface 201 is an interface from a computer (PC) 200, which develops print data in an image and outputs to the image signal control unit 204. Images read by an image sensor is output to the image signal control unit 204 from the image reader control unit 203 and the image output to the printer control unit 205 from the image signal control unit 204 is input in an exposure control unit.

Figure 8:
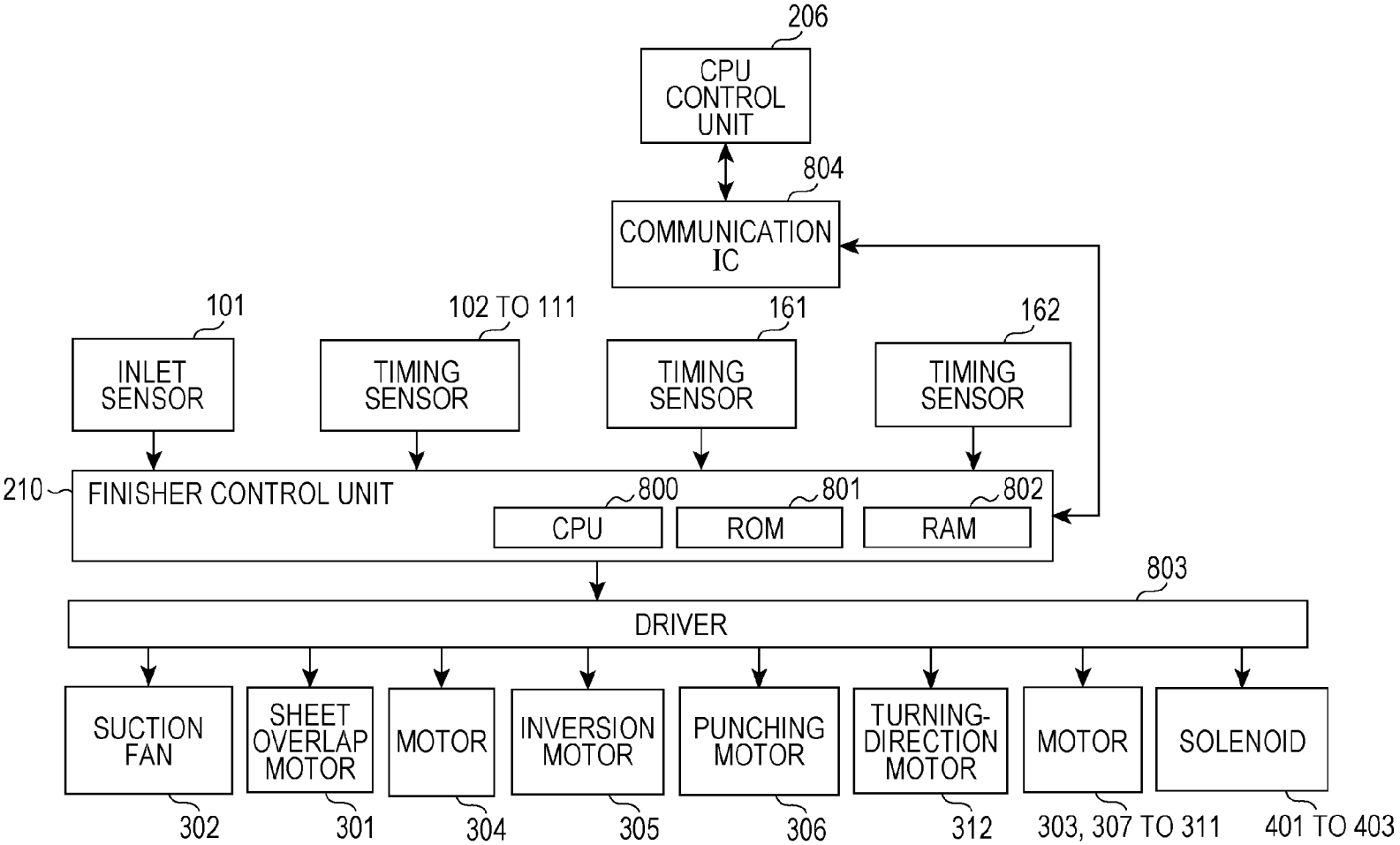
FIG. 8 is a control block diagram of a finisher control unit which controls the finisher.

The finisher control unit 210 is provided in the finisher 100 and performs the driving control of the entire finisher by exchanging information with the CPU circuit unit 206. Here, the finisher control unit 210 which performs the driving control of the finisher 100 includes a CPU 800, ROM 801 and RAM 802, as illustrated in FIG. 8. The finisher control unit 210 communicates with the CPU circuit unit 206 via a communication IC 804 and performs data exchange and executes various programs stored in the ROM 801 in accordance with the instruction from the CPU circuit unit 206 to perform the driving control of the finisher 100.

Here, when the driving control is performed, detection signals from various sensors for controlling the finisher 100 are taken into the finisher control unit 210. These various sensors include the inlet sensor 101 illustrated in FIG. 2 described above, and timing sensors 102 to 111, 161 and 162 for detection and conveyance control of the sheet P. A driver 803 is connected to the finisher control unit 210. Solenoids 401 to 403 for switching among switching members 141 to 143 in accordance with signals from the finisher control unit 210 is connected to the driver 803.

In addition to the sheet overlap motor 301, the suction fan 302, the inversion motor 305, the punching motor 306, which are described above, a motor 311 which drives the inlet roller pair 121 and a turning-direction motor 312 which drives a turning-direction paddle 167 which will be described later are connected to the driver 803. A motor 303 which drives the conveying roller pairs 122, 123 and 163, a motor 304 which drives the conveying roller pairs 124 and 166, a motor 307 which drives the conveying roller pairs 125 and 126, and a motor 308 which drives the conveying roller pairs 127 and 128 are connected to the driver 803. A motor 309 which drives the conveying roller pair 129 to 131 and a motor 310 which drives the bundle discharge roller pair 133 are connected to the driver 803.

The finisher control unit 210 controls the finisher 100 in accordance with the signal from each of these sensors by driving each of the motors and the solenoids 401 to 403. Although the finisher 100 is controlled by the finisher control unit 210 in the present embodiment, the finisher 100 may be controlled by the CPU circuit unit 206 provided in the apparatus main body 900A.

In the present embodiment, in the punching process of the sheet, the sheet inverting unit 170 conveys the sheet to which the punching process has been performed to the downstream side and the subsequent sheet to which the punching process is to be performed is conveyed to the sheet punching unit 190 while passing by the sheet to which the punching process has been performed and is directed to the downstream side.

Figure 10:
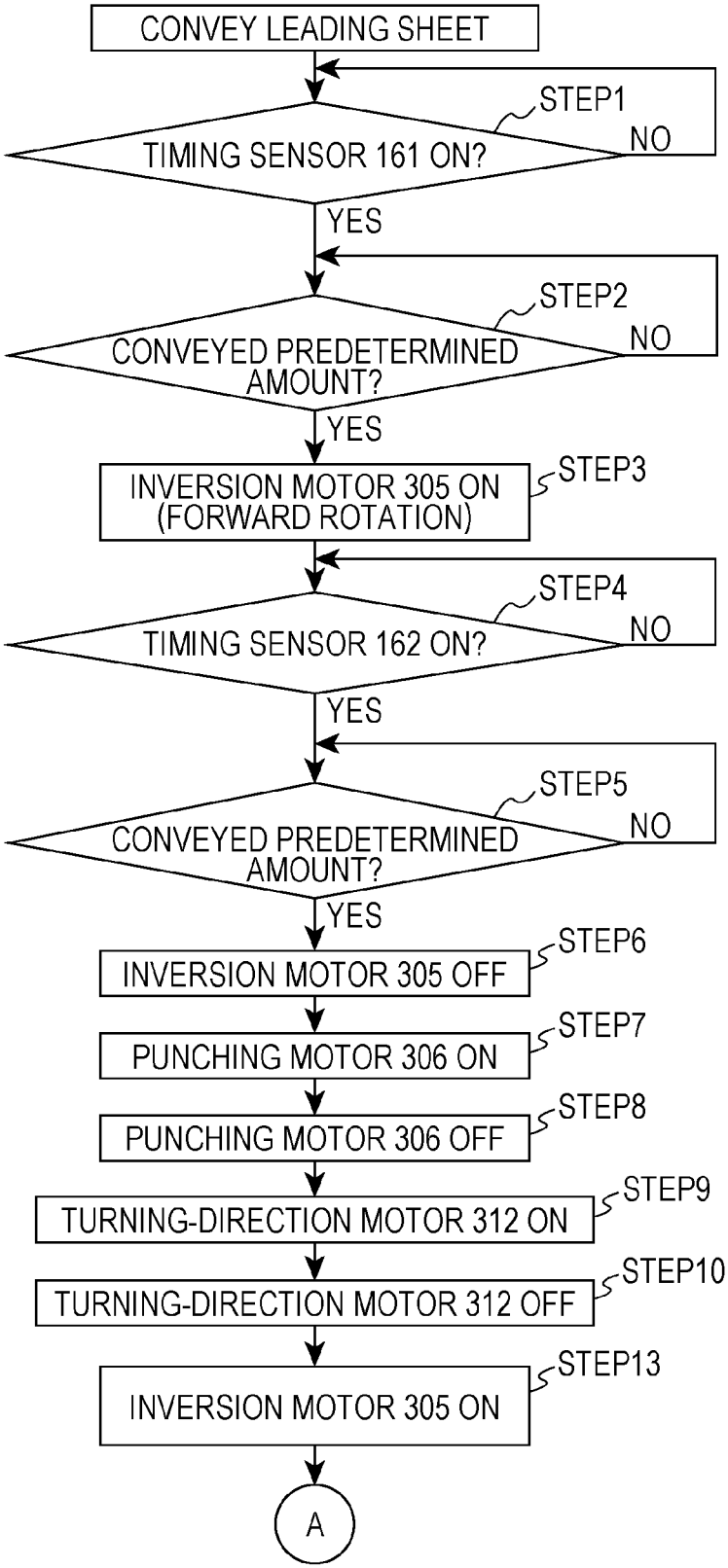
FIG. 10 is a flowchart illustrating a punching operation of the finisher.
Figure 11:
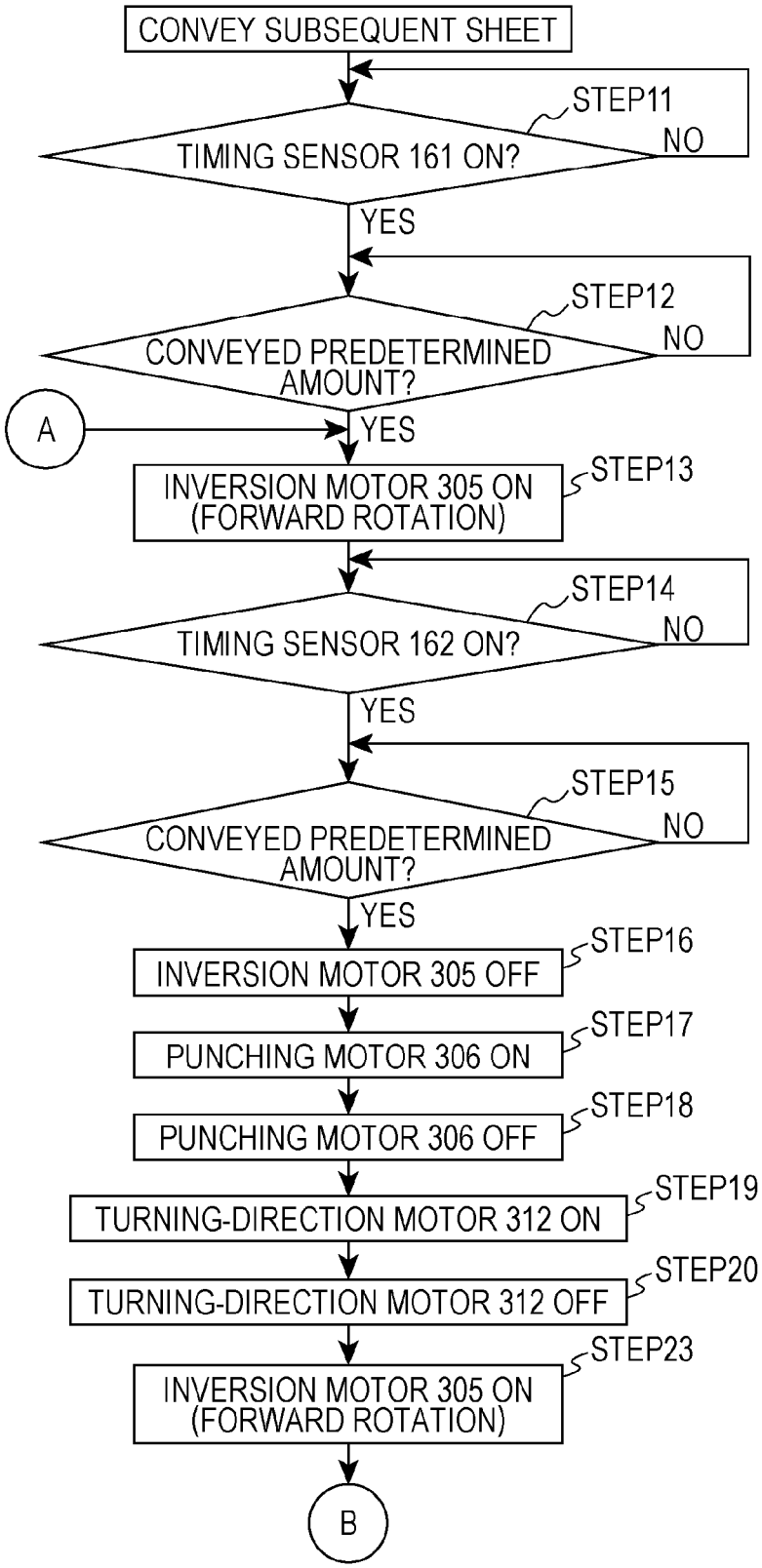
FIG. 11 is a flowchart illustrating the punching operation of the finisher.

Next, a sheet punching process according to the present embodiment will be described with reference to FIGS. 9A to 9D and the flowcharts of FIGS. 10 to 12. In FIGS. 9A to 9D, the reference numeral 167 denotes a turning-direction paddle which forms a turning-direction unit. The turning-direction paddle 167 is disposed at a branching point SP of the sheet conveying path R2 and the return path R3. The turning-direction paddle 167 includes an elastic fan 168. The turning-direction paddle 167 may turn the rear end of the sheet which is conveyed in a state in which rear end overlaps the leading end of the subsequent sheet to the direction of the return path R3 and may separate from the subsequent sheet. Therefore, the rear end of the sheet, inverted by the sheet inverting unit 170, opposite to the end of the side of the punching unit may be reliably guided to the return path R3 which will be described later.

Figure 9A:
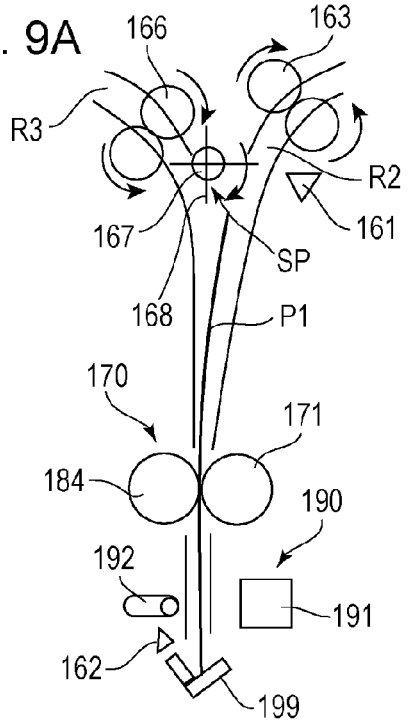
FIGS. 9A to 9D are diagrams illustrating a punching operation of the finisher.

If the punching process is performed to a plurality of sheets continuously, a sheet P1 and a sheet P2, of which rear ends are placed to overlap a leading end of a subsequent sheet by the sheet overlapping portion 150 are guided to the sheet conveying path R2 by the switching member 141 as illustrated in FIG. 9A. As illustrated in FIG. 10, when the leading end of the first sheet (preceding sheet) P1 is detected and the timing sensor 161 is turned ON (STEP1: YES), the sheet P1 is conveyed to the sheet inverting unit 170. Then, when the sheet P1 is conveyed by a predetermined amount (STEP2: YES) and the sheet P1 reaches before the sheet inverting unit 170, the inversion motor 305 is driven to rotate in the forward direction (turned ON) (STEP3) and the driving roller 171 is rotated in the forward direction.

In this manner, the roll 172 and the rubber roller 185 are rotated in the direction illustrated in FIG. 5B described above and the sheet P1 is conveyed to the sheet punching unit 190. When the sheet P1 is detected and the timing sensor 162 is turned ON (STEP4: YES), the sheet P1 is conveyed by the predetermined amount until the sheet abuts against the positioning stopper 199. Next, after the sheet P1 is conveyed by the predetermined amount until the sheet P1 abuts against the positioning stopper 199 (STEP5: YES), the inversion motor 305 is stopped (turned OFF) (STEP6) and rotation of the driving roller 171 is stopped. Then, positioning of the sheet P1 is completed. After positioning of the sheet P1 is completed, the punching motor 306 is driven (turned ON) (STEP7) and the sheet P1 is punched. After punching in the sheet P1 is finished, the punching motor 306 is stopped (turned OFF) (STEP8).

Figure 9B:
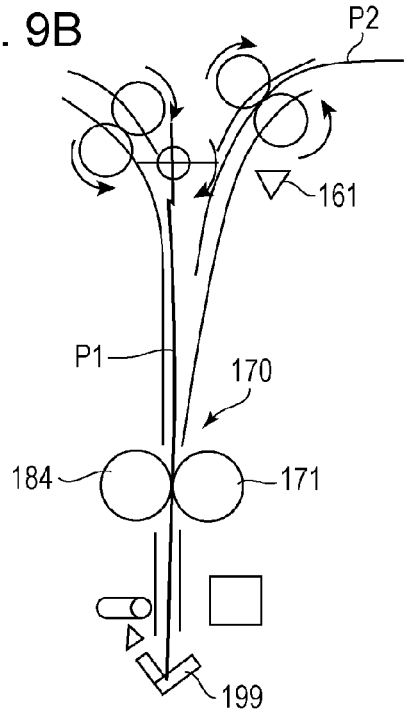

Next, the turning-direction motor 312 is driven (turned ON) for a predetermined time (STEP9), and the turning-direction paddle 167 is rotated so that the sheet rear end is turned to the return path R3. Then, the turning-direction motor 312 is stopped (turned OFF) (STEP10). During this process, as illustrated in FIG. 9B, the leading end of the subsequent second sheet (subsequent sheet) P2 is detected by the timing sensor 161. When the second sheet P2 is detected in this manner and the timing sensor 161 is turned ON as illustrated in FIG. 11 (STEP11: YES), then, the sheet P2 is conveyed to the sheet inverting unit 170 by a predetermined amount.

Figure 9C:
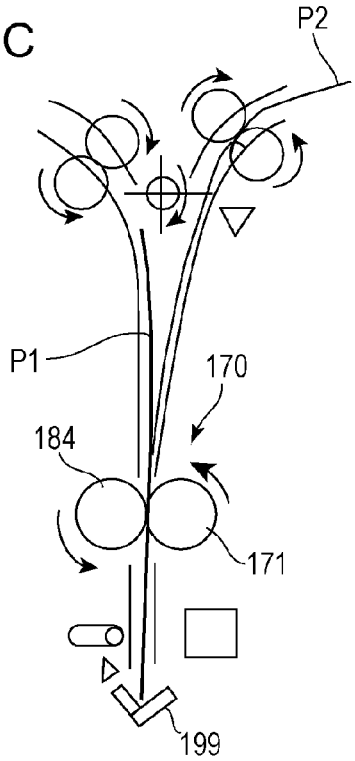

Next, when the sheet P2 is conveyed by a predetermined amount (STEP12: YES) and the sheet P2 reaches before the sheet inverting unit 170 as illustrated in FIG. 9C, the inversion motor 305 is driven to rotate in the forward direction (turned ON) (STEP13) and the driving roller 171 is rotated in the forward direction. In this manner, the leading end of the subsequent second sheet P2 is nipped by the driving roller 171 and the driving roll 184 while being in contact with the driving roller 171 and, therefore, the driving roller 171 and the driving roll 184 altogether nip the two sheets.

Figure 9D:
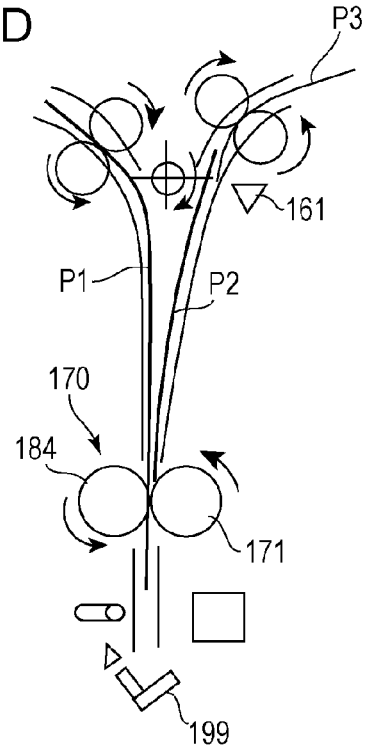

Next, the subsequent sheet P2 is conveyed by the driving roller 171 and when the sheet P2 is detected by the timing sensor 162 and the timing sensor 162 is turned ON (STEP14: YES). Then, the sheet is conveyed by the predetermined amount until the sheet abuts against the positioning stopper 199 (STEP15). On the other hand, if the driving roller 171 and the driving roll 184 nip two sheets, the roll 172 rotates in the direction of rotation of the driving shaft 174 as illustrated in FIG. 5B as described above. Thereby, as illustrated in FIG. 9D, the first sheet P1 is conveyed to the return path R3 at the sheet inverting unit 170 while passing by the subsequent sheet P2. That is, if the sheet P2 reaches the driving roller 171 and the driving roller 171 nips (pinches) the two sheets cooperatively with the driving roll 184, the sheet P2 is conveyed by the driving roller 171 to the sheet punching unit 190. The preceding sheet P1 is conveyed to the return path R3 while passing by the subsequent sheet P2.

Next, when the subsequent sheet P2 is conveyed by a predetermined amount until the sheet P2 abuts against the positioning stopper 199 (STEP15: YES), the inversion motor 305 is stopped (turned OFF) (STEP16) and rotation of the driving roller 171 is stopped. Therefore, positioning of the sheet is completed. Then, after positioning of the sheet is completed, the punching motor 306 is driven (turned ON) (STEP17), the sheet P2 is punched. After punching of the sheet P2 is finished, the punching motor 306 is stopped (turned OFF) (STEP18).

Next, the turning-direction motor 312 is driven (turned ON) for the predetermined time (STEP19), and the turning-direction paddle 167 is rotated so that the direction of the sheet rear end is turned to the return path R3 and then the turning-direction motor 312 is stopped (turned OFF) (STEP20). During this process, the leading end of the third sheet is detected by the timing sensor 161 and processes of the STEP11 to STEP20 and STEP23 described above are performed to this third sheet. Then, the same process is performed until the last sheet is conveyed.

Figure 12:
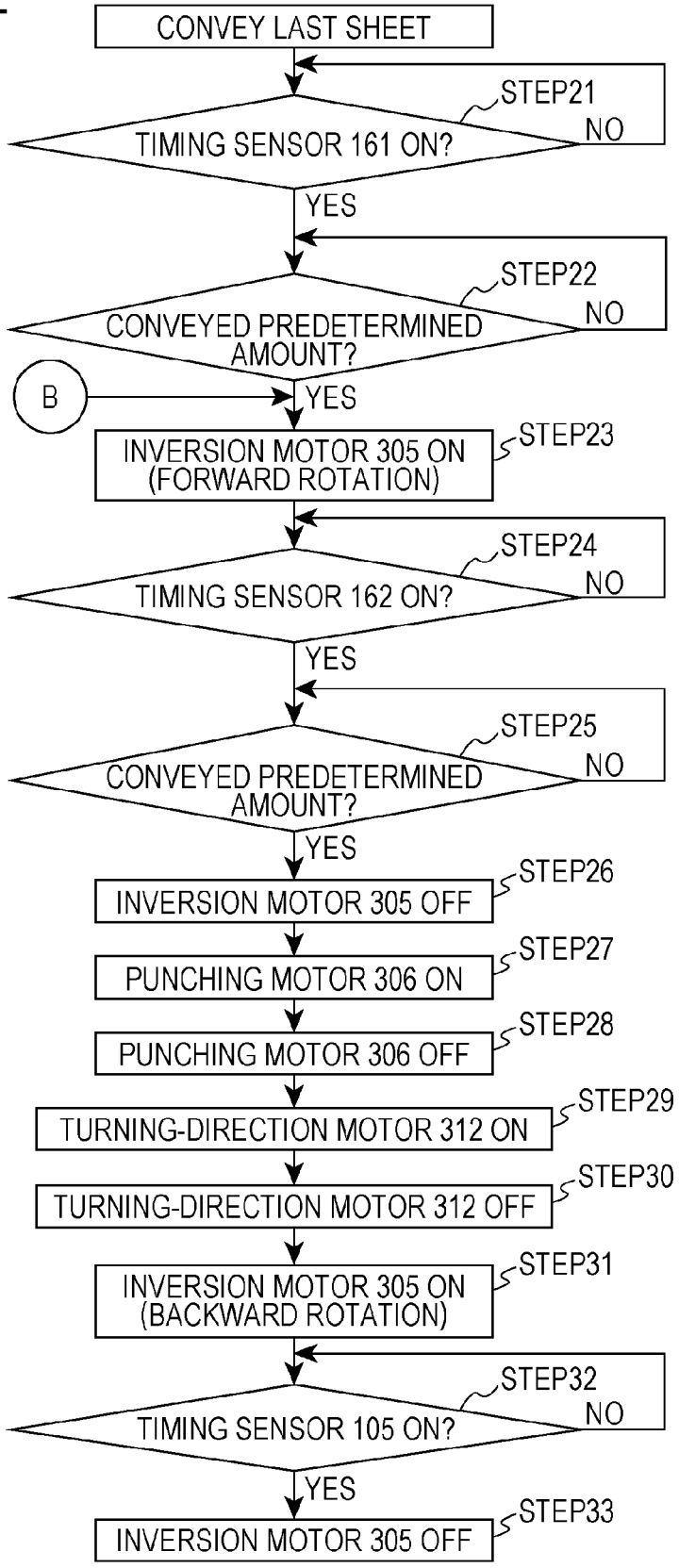
FIG. 12 is a flowchart illustrating the punching operation of the finisher.

Next, the last sheet is conveyed and when the timing sensor 161 detects the last sheet and is turned ON as illustrated in FIG. 12 (STEP21: YES), the last sheet is conveyed to the sheet inverting unit 170. Then, when the last sheet is conveyed by a predetermined amount (STEP22: YES) and the last sheet reaches before the sheet inverting unit 170, the inversion motor 305 is driven to rotate in the forward direction (turned ON) (STEP23) and the driving roller 171 is rotated in the forward direction. In this manner, the leading end of the last sheet is nipped by the driving roller 171 and the driving roll 184 and, therefore, the driving roller 171 and the driving roll 184 altogether nip the two sheets.

Next, the last sheet is conveyed by the driving roller 171 and when the last sheet is detected and the timing sensor 162 is turned ON (STEP24: YES), then, the last sheet is conveyed by the predetermined amount until the last sheet abuts against the positioning stopper 199 (STEP25). On the other hand, if the driving roller 171 and the driving roll 184 nip two sheets, the second-to-last sheet is conveyed to the return path R3 in the sheet inverting unit 170 while passing by the last sheet.

Next, after the last sheet is conveyed by the predetermined amount until the last sheet abuts against the positioning stopper 199 (STEP25: YES), the inversion motor 305 is stopped (turned OFF) (STEP26) and rotation of the driving roller 171 is stopped. Then, positioning of the sheet is completed. After positioning of the last sheet is completed, the punching motor 306 us driven (turned ON) (STEP27), the last sheet is punched. After punching in the last sheet is finished, the punching motor 306 is stopped (turned OFF) (STEP28). Next, the turning-direction motor 312 is driven (turned ON) for a predetermined time (STEP29), and the turning-direction paddle 167 is rotated so that the sheet rear end is turned to the return path R3. Then, the turning-direction motor 312 is stopped (turned OFF) (STEP30).

In a case of the last sheet, after the punching process and the turning-direction process are performed, the inversion motor 305 is driven to rotate in the backward direction (STEP31). Then, the driving roller 171 is rotated in the backward direction such that the last sheet is returned and is guided to the conveying roller pair 166 provided in the return path R3. If the timing sensor 105 detects passing through of the sheet rear end and is turned ON (STEP32: YES), the inversion motor 305 is made to stop (turned OFF) (STEP33). Then, the sheet is sequentially conveyed inside the finisher 100 and is discharged to the upper tray 147 or to the stacking tray 148.

As described above, in the present embodiment, when the subsequent sheet reaches the sheet inverting unit 170, the sheet to which the punching process has been performed is conveyed to the return path R3 while passing by the subsequent sheet conveyed to the sheet punching unit 190. In this manner, the positioning of the subsequent sheet and the conveyance of the already processed sheet may be carried out at the same time.

That is, when the subsequent sheet reaches the sheet inverting unit 170, the sheet is conveyed to the sheet punching unit 190 by the driving roller 171 while the sheet to which the punching process has been performed by the driving roll 184 is returned to the return path R3. Therefore, the punching process may be performed efficiently. As a result, sheet ventilation time can be shortened, and even when connected to small image forming apparatus between papers, high throughput correspondence is attained.

Although the case in which the sheets are stacked such that the rear end portion of the preceding sheet is placed over the leading end of the subsequent sheet in the foregoing description, if the sheets are not stacked in this manner, the punching process may be performed efficiently in the same operation. Although the configuration in which the driving roll 184 is driven to rotate by the driving roller 171 via the torque limiter 173 in the present embodiment has been described, the present invention is not limited to the same. For example, each of the driving roller 171 and the driving roll 184 may be rotated by a driving source, such as a motor, and the timing of the start, stop, forward rotation and backward rotation of each driving roller may be determined in accordance with detection result of the timing sensors 161 and 162.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-044510, filed Feb. 29, 2012 which is hereby incorporated by reference herein in its entirety.

What is claimed is:

1. A sheet processing device, comprising:

a punching unit configured to perform a punching process to a sheet;

a sheet conveying path configured to guide the sheet to the punching unit;

a branching conveying path configured to be branched from the sheet conveying path;

a sheet inverting unit provided between a branching point and the punching unit, the branching point being the point at which the branching conveying path is branched from the sheet conveying path, the sheet inverting unit including a first rotary member rotatably mounted thereon and a second rotary member rotatably mounted thereon in forward and backward directions;

a positioning portion configured to position the sheet, the positioning portion is provided at a position so that a distance between a nip portion nipped by the first rotary member and the second rotary member and a contact portion where an edge of the sheet at the positioning portion contacts, to be shorter than a length of sheet in a sheet conveyance direction; and a control unit configured to perform a control so that the punching unit performs the punching process to the sheet that is nipped by the first rotary member and the second rotary member and positioned by the positioning portion, and wherein, when a second sheet, to which the punching process is to be performed, is nipped by the first rotary member and the second rotary member which nip a first sheet to which the punching process has already been performed, the sheet inverting unit conveys the first sheet to the branching conveying path while conveying the second sheet to the punching unit.

2. The sheet processing device according to claim 1, further comprising:

the control unit controls the sheet inverting unit so that conveyance of the sheet is stopped when the sheet reaches the positioning unit and controls the punching unit such that the punching process of the positioned sheet before the second sheet is nipped by the first rotary member and the second rotary member.

3. The sheet processing device according to claim 1, further comprising a turning-direction unit, disposed at the branch point, configured to change a direction of an end of the first sheet opposite to an end on the side of the punching unit toward the branching conveying path before the first sheet is conveyed by the second rotary member.

4. The sheet processing device according to claim 1, further comprising an overlapping unit configured to convey the first sheet to the sheet inverting unit with an upstream end portion of the first sheet in a sheet conveying direction overlapping a downstream end portion of the second sheet in the sheet conveying direction.

5. The sheet processing device according to claim 1, further comprising a torque limiter provided to the second rotary member so that the second rotary member is driven to rotate by the first rotary member.

6. An image forming system, comprising:

an image forming unit configured to form an image on a sheet;

a punching unit configured to perform a punching process to a sheet on which the image has been formed;

a sheet conveying path configured to guide the sheet to the punching unit;

a branching conveying path configured to be branched from the sheet conveying path;

a sheet inverting unit provided between a branching point and the punching unit, the branching point being the point at which the branching conveying path is branched from the sheet conveying path, the sheet inverting unit including a first rotary member rotatably mounted thereon and a second rotary member rotatably mounted thereon in forward and backward directions;

a positioning portion configured to position the sheet, the positioning portion is provided at a position so that a distance between a nip portion nipped by the first rotary member and the second rotary member and a contact portion where an edge of the sheet at the positioning portion contacts, to be shorter than a length of sheet in a sheet conveyance direction; and a control unit configured to perform a control so that the punching unit performs the punching process to the sheet that is nipped by the first rotary member and the second rotary member and positioned by the positioning portion, and wherein, when a second sheet, to which the punching process is to be performed, is nipped by the first rotary member and the second rotary member which nip a first sheet to which the punching process has already been performed, the sheet inverting unit conveys the first sheet to the branching conveying path while conveying the second sheet to the punching unit.

7. The image forming system according to claim 6, further comprising:

the control unit controls the sheet inverting unit so that conveyance of the sheet is stopped when the sheet reaches the positioning unit and controls the punching unit such that the punching process of the positioned sheet before the second sheet is nipped by the first rotary member and the second rotary member.

8. The image forming system according to claim 6, further comprising a turning-direction unit, disposed at the branch point, configured to change the direction of an end of the first sheet opposite to an end on the side of the punching unit toward the branching conveying path before the first sheet is conveyed by the second rotary member.

9. The image forming system according to claim 6, further comprising an overlapping unit configured to convey the first sheet to the sheet inverting unit with an upstream end portion of the first sheet in a sheet conveying direction overlapping a downstream end portion of a second sheet in the sheet conveying direction.

10. The image forming system according to claim 6, further comprising a torque limiter provided to the second rotary member so that the second rotary member is driven to rotate by the first rotary member.

11. A sheet processing device, comprising:

a punching unit configured to perform a punching process to a sheet;

a sheet conveying path configured to guide the sheet to the punching unit;

a branching conveying path configured to be branched from the sheet conveying path;

a pair of inverting rotary members which is provided between a branching point at which the branching conveying path is branched from the sheet conveying path and the punching unit, and includes a first rotary member rotatably mounted thereon and a second rotary member rotatably mounted thereon in forward and backward directions;

a positioning portion configured to position the sheet, the positioning portion is provided at a position so that a distance between a nip portion nipped by the first rotary member and the second rotary member and a contact portion where an edge of the sheet at the positioning portion contacts, to be shorter than a length of sheet in a sheet conveyance direction; and a control unit configured to perform a control so that the punching unit performs the punching process to the sheet that is nipped by the first rotary member and the second rotary member and positioned by the positioning portion, and a torque limiter provided to the second rotary member, wherein the torque limiter is configured such that when a plurality of sheets is nipped by the first rotary member and the second rotary member, a sheet to which the punching process is performed is conveyed to the branching conveying path and the other sheet is conveyed to the punching unit.

12. The sheet processing device according to claim 11, further comprising a turning-direction unit, disposed at the branch point, configured to change a direction of an end of the sheet opposite to an end on the side of the punching unit toward the branching conveying path before the sheet is conveyed by the second rotary member.

13. The sheet processing device according to claim 11, further comprising an overlapping unit configured to convey a first sheet to the pair of inverting rotary members with an upstream end portion of the first sheet in a sheet conveying direction overlapping a downstream end portion of a second sheet, being conveyed following the first sheet, in the sheet conveying direction.

14. An image forming system, comprising:

an image forming unit configured to form an image on a sheet;

a punching unit configured to perform a punching process to a sheet on which the image has been formed;

a sheet conveying path configured to guide the sheet to the punching unit;

a branching conveying path configured to be branched from the sheet conveying path;

a pair of inverting rotary members which is provided between a branching point at which the branching conveying path is branched from the sheet conveying path and the punching unit, and includes a first rotary member rotatably mounted thereon and a second rotary member rotatably mounted thereon in forward and backward directions, a positioning portion configured to position the sheet, the positioning portion is provided at a position so that a distance between a nip portion nipped by the first rotary member and the second rotary member and a contact portion where an edge of the sheet at the positioning portion contacts, to be shorter than a length of sheet in a sheet conveyance direction; and a control unit configured to perform a control so that the punching unit performs the punching process to the sheet that is nipped by the first rotary member and the second rotary member and positioned by the positioning portion, and a torque limiter provided to the second rotary member, wherein the torque limiter is configured such that when a plurality of sheets is nipped by the first rotary member and the second rotary member, a sheet to which the punching process is performed is conveyed to the branching conveying path and the other sheet is conveyed to the punching unit.

15. The image forming system according to claim 14, further comprising a turning-direction unit, disposed at the branch point, configured to change the direction of an end of the sheet opposite to an end on the side of the punching unit toward the branching conveying path before the sheet is conveyed by the second rotary member.

16. The image forming system according to claim 14, further comprising an overlapping unit configured to convey a first sheet to the pair of inverting pair of with an upstream end portion of the first sheet in a sheet conveying direction overlapping a downstream end portion of a second sheet, being conveyed following the first sheet, in the sheet conveying direction.

* * * * *